United States Patent [19]

Norman

[11] 4,339,979

[45] Jul. 20, 1982

[54] ELECTRONIC MUSIC INSTRUMENT

[76] Inventor: Travis Norman, 2232 Shadow Dale, Houston, Tex. 77043

[21] Appl. No.: 105,972

[22] Filed: Dec. 21, 1979

Related U.S. Application Data

[63] Continuation-in-part of Ser. No. 971,855, Dec. 21, 1978, abandoned.

[51] Int. Cl.[3] ..... G10H 1/057; G10H 1/08

[52] U.S. Cl. ..... 84/1.23; 84/1.26; 84/DIG. 2; 84/DIG. 30

[58] Field of Search ..... 84/1.01, 1.03, 1.13, 84/1.22, 1.23, 1.26, DIG. 2, DIG. 22, DIG. 30

[56] References Cited

U.S. PATENT DOCUMENTS

| | | | |
|---|---|---|---|
| 3,340,343 | 9/1967 | Woll | 84/1.13 |
| 3,555,166 | 1/1971 | Gasser | 84/1.01 |
| 3,662,641 | 5/1972 | Allen et al. | 84/1.01 |
| 3,842,702 | 10/1974 | Tsundoo | 84/1.01 |
| 3,886,836 | 6/1975 | Hiyoshi | 84/1.26 |
| 3,939,751 | 2/1976 | Harasek | 84/1.01 X |
| 4,078,464 | 3/1978 | Sugiyama | 84/1.01 |
| 4,085,645 | 4/1978 | Ryon | 84/1.01 |
| 4,177,705 | 12/1979 | Evangelista | 84/1.01 X |

*Primary Examiner*—Stanley J. Witkowski

*Attorney, Agent, or Firm*—Pravel, Gambrell, Hewitt, Kirk & Kimball

[57] ABSTRACT

An electronic musical instrument forms output signals having at least one frequency component and an amplitude defining envelope. Output signals are formed for selected string simulators on the instrument so that the notes and chords may be formed simulating a stringed musical instrument by combining the output signals. Various parameters of the amplitude envelope of the output signals may be varied at a user's selection.

11 Claims, 7 Drawing Figures

ELECTRONIC MUSIC INSTRUMENT

CROSS REFERENCE TO RELATED APPLICATIONS

The present application is a continuation-in-part of co-pending U.S. patent application Ser. No. 971,855 filed Dec. 21, 1978 and now abandoned.

FIELD OF THE INVENTION

The present invention relates to electronic music instruments.

DISCLOSURE OF THE PRIOR ART

Prior electronic music instruments have been used to simulate stringed instruments, such as guitars, and also apparently as replacements for such instruments. Examples of these types of instruments are set forth in U.S. Pat. Nos. 3,340,343; 3,555,166, 3,662,641 and 4,078,464.

In the instrument described in U.S. Pat. No. 3,555,166, separate tone generators or oscillators were apparently used for each of the particular musical sounds which the instrument being simulated was capable of producing. U.S. Pat. Nos. 3,340,343 and 4,078,464 reduced the number of oscillators to a number equalling the number of strings on the instrument being simulated. In U.S. Pat. No. 3,340,343, a tap inductor coil controlled the oscillator output frequency, while in U.S. Pat. No. 4,078,464, a resistive ladder controlled the output frequency of a voltage-controlled oscillator to form the frequencies of the musical notes from the simulating instrument.

The instrument in U.S. Pat. No. 3,662,641 included both strings for bowing or plucking and touch actuated switches simulating a finger board. The touch actuated switches apparently controlled the frequency of the music sounds or notes formed while strumming of the strings controlled amplitude and partially the rise and fall duration of the sounds and any desired special effects.

SUMMARY OF THE INVENTION

Briefly, the present invention provides a new and improved electronic musical instrument which electronically forms output signals which have at least one frequency component and an amplitude defining envelope. The output signals so formed simulate musical notes and chords from a stringed musical instrument.

Input circuits for each string receive from a user an indication of the output signal to be formed. A digital circuit forms digital count signals defining the frequency component of the output signal to be formed. An oscillator forms a reference clock frequency pulse signal which is provided to a digital counter. The digital counter also receives the digital count signal from the digital circuit and divides the clock frequency by the digital count signal to form the output signal frequency. An envelope control circuit then forms the envelope of the output signal so that musical notes and chords are simulated.

DESCRIPTION OF PREFERRED EMBODIMENT

Figure 1:
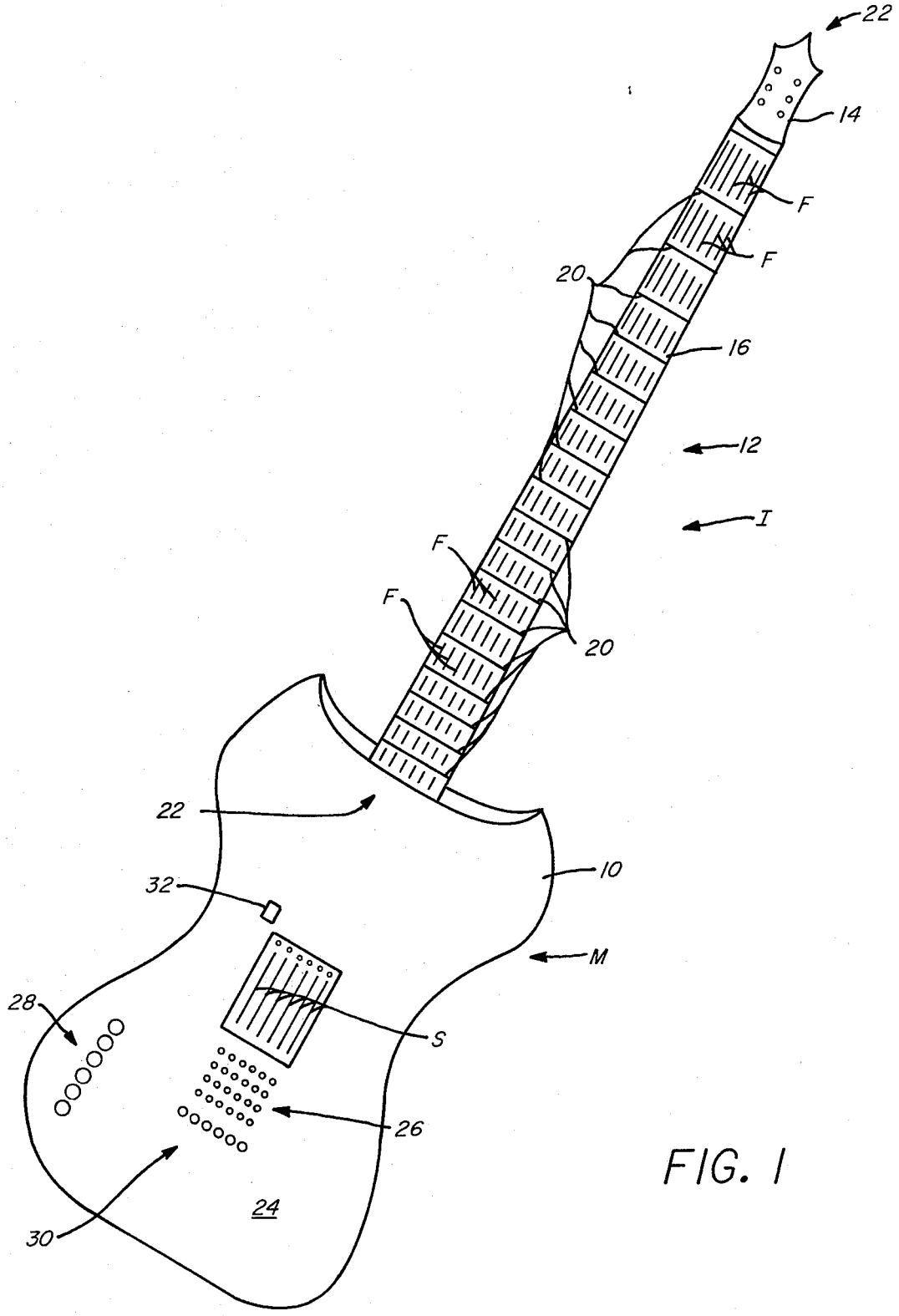
FIG. 1 is an isometric view of an instrument according to the present invention.

In the drawings, the letter I (FIG. 1) designates generally an electronic musical instrument for electronically forming output signals to simulate musical notes and chords from a stringed musical instrument such as a guitar, ukulele, banjo or the like. As used in the present invention, the term simulating is intended to mean that the instrument I may be played to produce audible music electronically by a user for entertainment or other purposes for which a stringed instrument is used, although the music notes and chords are formed in a different manner. Thus, the instrument I electronically forms output signals having at least one frequency component and an amplitude defining envelope to simulate musical notes and chords from a stringed musical instrument.

The instrument I is preferably of the same general physical size and appearance as the type of instrument being simulated, for greater ease of operation and familiarity for a user. In the preferred embodiment, the instrument I simulates an electric guitar and accordingly is in the form of a body portion or box 10 (FIG. 1) having a neck portion 12 extending outwardly thereform to a head member 14. A finger board or bridge 16 on the neck 12 has a plurality of lateral ridges or frets 20 formed thereon, much in the manner of an electric guitar or conventional stringed guitar.

With the present invention, the strings or prior guitars and the mechanical switches of the prior art electronic instruments discussed hereinabove have been replaced by capacitive or current/touch sensitive fret touch pads F which are provided on the neck portion 12 in a series of transverse rows 22 extending between each adjacent pair of the frets 20. The touch pads F extend downwardly in a series of aligned rows 22 over the bridge 16, with each of the aligned rows of touch pads F intended to replace either the strings or mechanical switches of prior stringed or electronic instruments, respectively. Further, a plurality of current/touch sensitive string touch pads S are provided on a face portion 24 of the box 10. The number of touch pads S is equal in number to the number of strings on the instrument which is being simulated by the instrument I. The touch pads F and S are of the type often used as input electrical switches which respond to contact by a finger of a user and sense the ambient electric current present in a person's body due to static electricity, ambient sixty hertz or other frequency electricity by becoming conductive in response to the electrical signal transferred thereto by the contact with the user's finger.

The fret touch pads F and the string touch pads S form a portion of an input means M for receiving an indication from the user of the output signal to be formed. In the input means M, a plurality of input switches 26 equal in number to the string touch pads S and each associated with one of such touch pads, are mounted on the body portion 10 and permit, in a manner to be set forth below, the user to cause the instrument I to selectively form harmonic frequencies for the notes and chords being formed in the instrument I. A group of control knobs 28 are also mounted on the body portion 10 and permit a user to specify the envelope of the output signal, in a manner to be set forth. Finally, another group of control knobs 30, again equal in number to the string touch pads S and each associated with one of such touch pads, are mounted on the body 10 to permit the user to indicate the level of the harmonic component for activated ones of the switches 26 in forming the musical notes and chords in the instrument I. A master on-off switch 32 is further mounted on the instrument I to permit the user to turn the instrument I off when its use is not desired. Suitable power is provided from an electrical input at a suitable location on the body portion 10 of the instrument I to provide operating electrical power for the electronic circuits contained therein.

With the present invention, each of the string touch pads S simulating a location on the instrument for strumming of a string are electrically connected to an electronic circuit E (FIG. 2) so that, when activated, an output signal is electronically formed having at least one frequency component and an amplitude defining envelope to form a musical note or chord in the instrument I with components from each string touch pad S contacted. Since each of the electronic circuits for the various string touch pads S in the instrument I are of like construction and function, only one is set forth in detail, it being understood that the remaining circuits are of like construction and function. Further, each of the fret touch pads F in a row 20 defining fret positions for one of the string touch pads is also connected to the electronic circuit E for the particular string touch pad associated therewith.

In the electronic circuit E (FIG. 2) an oscillator or clock 34 forms a reference clock frequency pulse signal while a digital circuit 36 forms digital count signals defining the frequency component of the output signal to be formed. A digital counter circuit 38 responds to the digital count signal from the digital circuit 36 and divides the reference clock frequency pulse signal formed in the oscillator 34 to form the output signal frequency for the output signal to be formed. Finally, an envelope control or pulse shaping network 40 forms the envelope of the output signal and provides the envelope of the output signal through a voltage-controlled amplifier 42 amplifier 42 also receives the output frequency signal so that the frequency component and the amplitude defining envelope of the musical note or chord for the string touch pad S contacted are formed. The output from the voltage controlled amplifier 42 for each of the particular string touch pads S contacted is provided to a mixer 44 which combines the various output signals from the voltage controlled amplifiers (VCS's) 42 and furnishes them to an output speaker so that an output signal simulating notes and chords from a musical instrument is formed by the instrument I.

Figure 2:
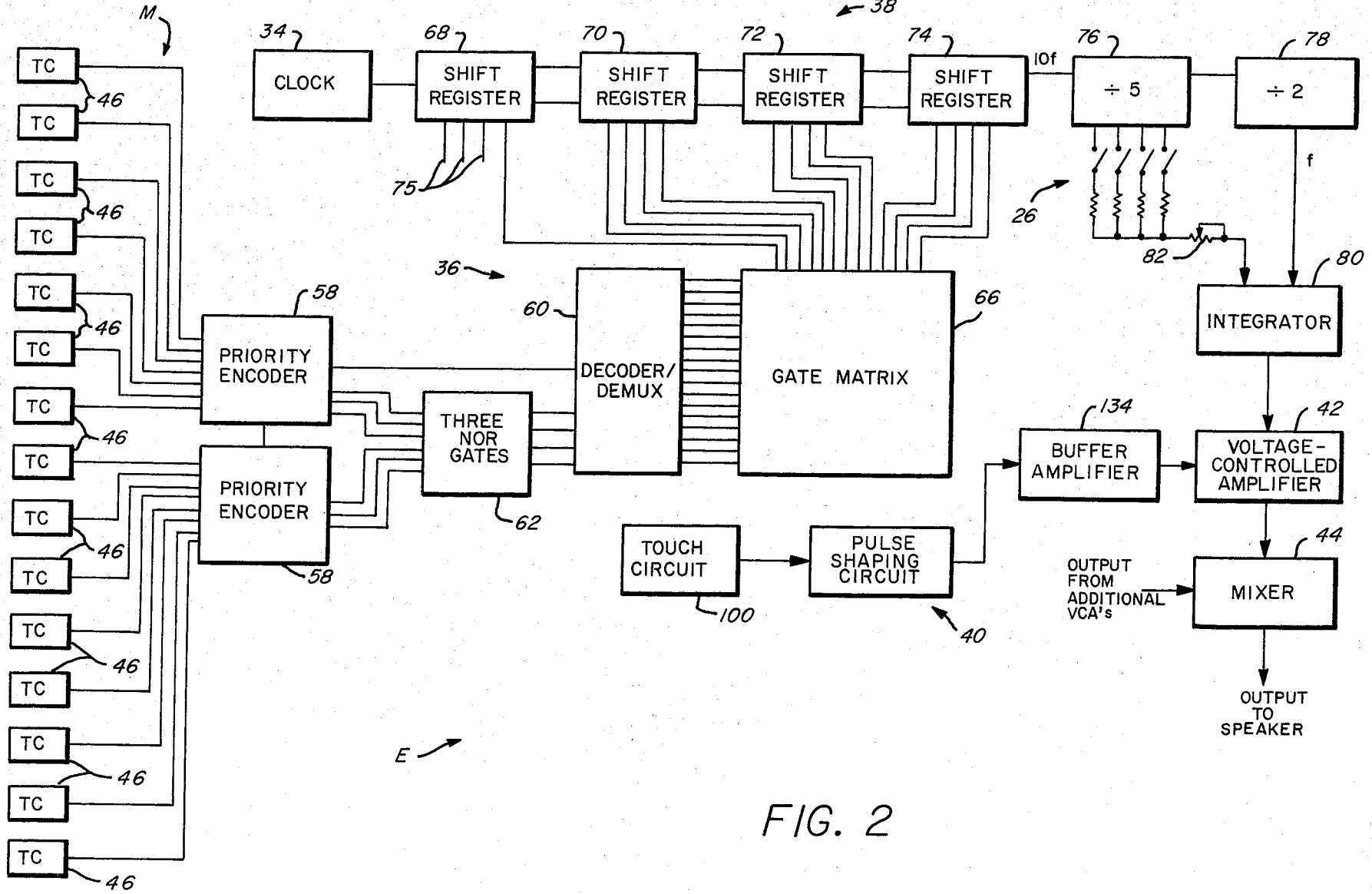
FIG. 2 is a schematic electrical circuit diagram of an electronic circuit for simulating one string according to the present invention.
Figure 3:
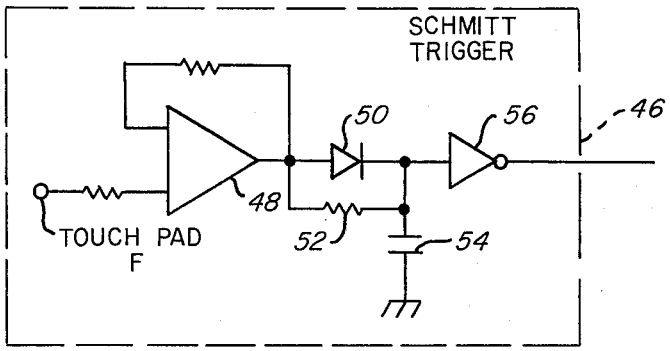
FIGS. 3, 4, 5 and 6 are schematic electrical circuit diagrams of certain components of the electronic circuit of FIG. 2.

Each of the fret touch pads F for the string associated therewith is electrically connected to the electronic circuit E through an individual touch circuit 46 (FIG. 2). As shown in FIG. 3, each touch circuit 46 includes an amplifier 48, diode 50, resistor 52 and capacitor 54 configured to function as a Schmitt trigger circuit which changes from a high to a low output level at the common point between diode 50 and resistor 52 when the touch pad F associated therewith is contacted by a user's finger. An inverter 56 responds by forming a high voltage level which is provided to one of two priority encoder or selector circuits 58 (FIG. 2). The priority encoder/selector circuits 58 respond by determining which of the touch pads F corresponding to the highest frequency note for the string touch pad S associated with electronic circuit E has been contacted by a user and forms a four bit binary number representing in binary form which one of the touch circuits 46 representing the highest frequency has been contacted by the user's fingers. The four bit binary number formed in the priority encoders 58 is provided directly via one bit to a decoder/demultiplexer circuit 60 of the digital circuit 36 and for the remaining three bits through parallel NOR gates for each bit through NOR gating circuits 62 to the decoder/demultiplexer 60.

Figure 5:
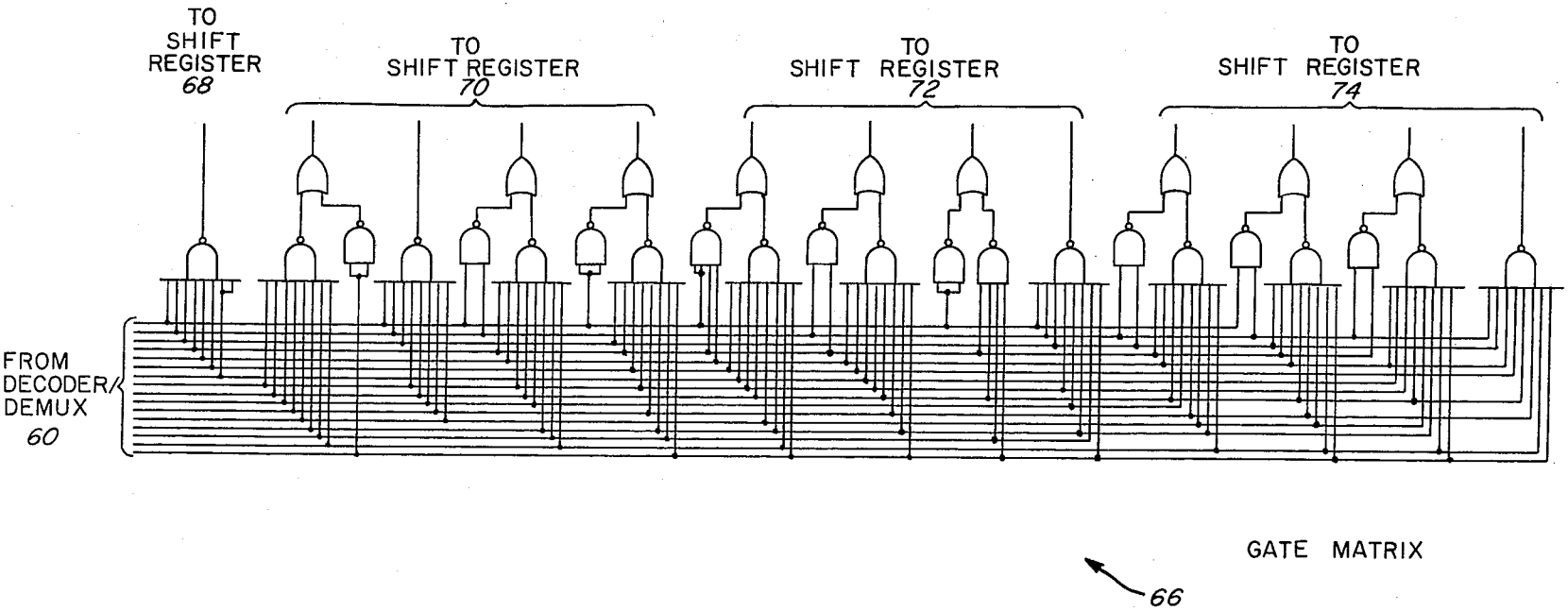

The decoder/demultiplexer 60 decodes the four bit number and provides an input signal on a particular one of a plurality of output conductors 64, one for each of the touch circuits 46, to a digital gating circuit 66 (FIGS. 2 and 5) in accordance with the particular one of the touch circuits 46 activated in the input means M for the highest frequency.

The gate matrix 66 receives the input signal designating the touch circuit 46 selected by the user and forms a sixteen bit digital code number defining the amount by which the output frequency of the clock 34 is to be divided by series connected counting shift registers 68, 70, 72 and 74 of the digital counter 38 to form the output signal frequency. In the preferred embodiment, the output signal frequency is at a predetermined integer multiple (such as ten) of the output frequency of the specified signal to be formed, for reasons to be set forth.

The following six charts set forth the various sixteen bit digital codes formed in the gate matrices 66 for each of the six simulated strings of a guitar for the various fret positions indicated by the decoder/demultiplexer 60:

CHART 1

LOW "E" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| −1 | 0 | 0 | 0 | 1 | 0 | 0 | 0 | 0 | 0 | 0 | 1 | 1 | 1 | 0 | 0 | 1 |
| 2 | 0 | 0 | 0 | 0 | 1 | 1 | 1 | 1 | 0 | 1 | 0 | 1 | 0 | 0 | 0 | 0 |
| 3 | 0 | 0 | 0 | 0 | 1 | 1 | 1 | 0 | 0 | 1 | 1 | 1 | 0 | 1 | 0 | 0 |
| 4 | 0 | 0 | 0 | 0 | 1 | 1 | 0 | 1 | 1 | 0 | 1 | 0 | 0 | 1 | 0 | 0 |
| 5 | 0 | 0 | 0 | 0 | 1 | 1 | 0 | 0 | 1 | 1 | 1 | 0 | 0 | 0 | 0 | 0 |
| 6 | 0 | 0 | 0 | 0 | 1 | 1 | 0 | 0 | 0 | 0 | 1 | 0 | 0 | 1 | 1 | 1 |
| 7 | 0 | 0 | 0 | 0 | 1 | 0 | 1 | 1 | 0 | 1 | 1 | 1 | 1 | 0 | 0 | 1 |
| 8 | 0 | 0 | 0 | 0 | 1 | 0 | 1 | 0 | 1 | 1 | 0 | 1 | 0 | 1 | 0 | 0 |
| 9 | 0 | 0 | 0 | 0 | 1 | 0 | 1 | 0 | 0 | 0 | 1 | 1 | 1 | 0 | 0 | 0 |
| 10 | 0 | 0 | 0 | 0 | 1 | 0 | 0 | 1 | 1 | 0 | 1 | 0 | 0 | 1 | 0 | 1 |
| 11 | 0 | 0 | 0 | 0 | 1 | 0 | 0 | 1 | 0 | 0 | 0 | 1 | 1 | 0 | 1 | 1 |
| 12 | 0 | 0 | 0 | 0 | 1 | 0 | 0 | 0 | 1 | 0 | 0 | 1 | 1 | 0 | 0 | 0 |
| 13 | 0 | 0 | 0 | 0 | 1 | 0 | 0 | 0 | 0 | 0 | 0 | 1 | 1 | 1 | 0 | 1 |
| 14 | 0 | 0 | 0 | 0 | 0 | 1 | 1 | 1 | 1 | 0 | 1 | 0 | 1 | 0 | 0 | 0 |
| 15 | 0 | 0 | 0 | 0 | 0 | 1 | 1 | 1 | 0 | 0 | 1 | 1 | 1 | 0 | 1 | 0 |

CHART 1-continued

LOW "E" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 16 | 0 | 0 | 0 | 0 | 0 | 1 | 1 | 0 | 1 | 1 | 0 | 1 | 0 | 0 | 1 | 0 |
| 17 | 0 | 0 | 0 | 0 | 0 | 1 | 1 | 0 | 0 | 1 | 1 | 1 | 0 | 0 | 0 | 0 |
| BIT NUMBER | 16 | 15 | 14 | 13 | 12 | 11 | 10 | 9 | 8 | 7 | 6 | 5 | 4 | 3 | 2 | 1 |

CHART 2

LOW "A" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 1 | 0 | 0 | 0 | 1 | 0 | 1 | 0 | 1 | 1 | 0 | 1 | 0 | 1 | 0 | 0 | 0 |
| 2 | 0 | 0 | 0 | 1 | 0 | 1 | 0 | 0 | 0 | 1 | 1 | 1 | 0 | 0 | 0 | 1 |
| 3 | 0 | 0 | 0 | 1 | 0 | 0 | 1 | 1 | 0 | 1 | 0 | 0 | 1 | 0 | 1 | 1 |
| 4 | 0 | 0 | 0 | 1 | 0 | 0 | 1 | 0 | 0 | 0 | 1 | 1 | 0 | 1 | 1 | 0 |
| 5 | 0 | 0 | 0 | 1 | 0 | 0 | 0 | 1 | 0 | 0 | 1 | 1 | 0 | 0 | 0 | 0 |
| 6 | 0 | 0 | 0 | 1 | 0 | 0 | 0 | 0 | 0 | 0 | 1 | 1 | 1 | 0 | 0 | 1 |
| 7 | 0 | 0 | 0 | 0 | 1 | 1 | 1 | 1 | 0 | 1 | 0 | 1 | 0 | 0 | 0 | 0 |
| 8 | 0 | 0 | 0 | 0 | 1 | 1 | 1 | 0 | 0 | 1 | 1 | 1 | 0 | 1 | 0 | 0 |
| 9 | 0 | 0 | 0 | 0 | 1 | 1 | 0 | 1 | 1 | 0 | 1 | 0 | 0 | 1 | 0 | 0 |
| 10 | 0 | 0 | 0 | 0 | 1 | 1 | 0 | 0 | 1 | 1 | 1 | 0 | 0 | 0 | 0 | 0 |
| 11 | 0 | 0 | 0 | 0 | 1 | 1 | 0 | 0 | 0 | 0 | 1 | 0 | 0 | 1 | 1 | 1 |
| 12 | 0 | 0 | 0 | 0 | 1 | 0 | 1 | 1 | 0 | 1 | 1 | 1 | 1 | 0 | 0 | 1 |
| 13 | 0 | 0 | 0 | 0 | 1 | 0 | 1 | 0 | 1 | 1 | 0 | 1 | 0 | 1 | 0 | 0 |
| 14 | 0 | 0 | 0 | 0 | 1 | 0 | 1 | 0 | 0 | 0 | 1 | 1 | 1 | 0 | 0 | 0 |
| 15 | 0 | 0 | 0 | 0 | 1 | 0 | 0 | 1 | 1 | 0 | 1 | 0 | 0 | 1 | 0 | 1 |
| 16 | 0 | 0 | 0 | 0 | 1 | 0 | 0 | 1 | 0 | 0 | 0 | 1 | 1 | 0 | 1 | 1 |
| 17 | 0 | 0 | 0 | 0 | 1 | 0 | 0 | 0 | 1 | 0 | 0 | 1 | 1 | 0 | 0 | 0 |
| BIT NUMBER | 16 | 15 | 14 | 13 | 12 | 11 | 10 | 9 | 8 | 7 | 6 | 5 | 4 | 3 | 2 | 1 |

CHART 3

LOW "D" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 1 | 0 | 0 | 0 | 1 | 1 | 1 | 0 | 0 | 1 | 1 | 1 | 0 | 1 | 0 | 0 | 0 |
| 2 | 0 | 0 | 0 | 1 | 1 | 0 | 1 | 1 | 0 | 1 | 0 | 0 | 1 | 0 | 0 | 1 |
| 3 | 0 | 0 | 0 | 1 | 1 | 0 | 0 | 1 | 1 | 1 | 0 | 0 | 0 | 0 | 0 | 1 |
| 4 | 0 | 0 | 0 | 1 | 1 | 0 | 0 | 0 | 0 | 1 | 0 | 0 | 1 | 1 | 1 | 1 |
| 5 | 0 | 0 | 0 | 1 | 0 | 1 | 1 | 0 | 1 | 1 | 1 | 1 | 0 | 0 | 0 | 1 |
| 6 | 0 | 0 | 0 | 1 | 0 | 1 | 0 | 1 | 1 | 0 | 1 | 0 | 1 | 0 | 0 | 0 |
| 7 | 0 | 0 | 0 | 1 | 0 | 1 | 0 | 0 | 0 | 1 | 1 | 1 | 0 | 0 | 0 | 1 |
| 8 | 0 | 0 | 0 | 1 | 0 | 0 | 1 | 1 | 0 | 1 | 0 | 0 | 1 | 0 | 1 | 1 |
| 9 | 0 | 0 | 0 | 1 | 0 | 0 | 1 | 0 | 0 | 0 | 1 | 1 | 0 | 1 | 1 | 0 |
| 10 | 0 | 0 | 0 | 1 | 0 | 0 | 0 | 1 | 0 | 0 | 1 | 1 | 0 | 0 | 0 | 0 |
| 11 | 0 | 0 | 0 | 1 | 0 | 0 | 0 | 0 | 0 | 0 | 1 | 1 | 1 | 0 | 0 | 1 |
| 12 | 0 | 0 | 0 | 0 | 1 | 1 | 1 | 1 | 0 | 1 | 0 | 1 | 0 | 0 | 0 | 0 |
| 13 | 0 | 0 | 0 | 0 | 1 | 1 | 1 | 0 | 0 | 1 | 1 | 1 | 0 | 1 | 0 | 0 |
| 14 | 0 | 0 | 0 | 0 | 1 | 1 | 0 | 1 | 1 | 0 | 1 | 0 | 0 | 1 | 0 | 0 |
| 15 | 0 | 0 | 0 | 0 | 1 | 1 | 0 | 0 | 1 | 1 | 1 | 0 | 0 | 0 | 0 | 0 |
| 16 | 0 | 0 | 0 | 0 | 1 | 1 | 0 | 0 | 0 | 0 | 1 | 0 | 0 | 1 | 1 | 1 |
| 17 | 0 | 0 | 0 | 0 | 1 | 0 | 1 | 1 | 0 | 1 | 1 | 1 | 1 | 0 | 0 | 1 |
| BIT NUMBER | 16 | 15 | 14 | 13 | 12 | 11 | 10 | 9 | 8 | 7 | 6 | 5 | 4 | 3 | 2 | 1 |

CHART 4

LOW "G" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 1 | 0 | 0 | 1 | 0 | 0 | 1 | 1 | 0 | 1 | 0 | 0 | 1 | 0 | 1 | 1 | 0 |
| 2 | 0 | 0 | 1 | 0 | 0 | 1 | 0 | 0 | 0 | 1 | 1 | 0 | 1 | 0 | 1 | 1 |
| 3 | 0 | 0 | 1 | 0 | 0 | 0 | 1 | 0 | 0 | 1 | 1 | 0 | 0 | 0 | 0 | 0 |
| 4 | 0 | 0 | 1 | 0 | 0 | 0 | 0 | 0 | 0 | 1 | 1 | 1 | 0 | 0 | 1 | 0 |
| 5 | 0 | 0 | 0 | 1 | 1 | 1 | 1 | 0 | 1 | 0 | 1 | 0 | 0 | 0 | 0 | 0 |
| 6 | 0 | 0 | 0 | 1 | 1 | 1 | 0 | 0 | 1 | 1 | 1 | 0 | 1 | 0 | 0 | 0 |
| 7 | 0 | 0 | 0 | 1 | 1 | 0 | 1 | 1 | 0 | 1 | 0 | 0 | 1 | 0 | 0 | 1 |
| 8 | 0 | 0 | 0 | 1 | 1 | 0 | 0 | 1 | 1 | 1 | 0 | 0 | 0 | 0 | 0 | 1 |
| 9 | 0 | 0 | 0 | 1 | 1 | 0 | 0 | 0 | 0 | 1 | 0 | 0 | 1 | 1 | 1 | 1 |
| 10 | 0 | 0 | 0 | 1 | 0 | 1 | 1 | 0 | 1 | 1 | 1 | 1 | 0 | 0 | 0 | 1 |
| 11 | 0 | 0 | 0 | 1 | 0 | 1 | 0 | 1 | 1 | 0 | 1 | 0 | 1 | 0 | 0 | 0 |
| 12 | 0 | 0 | 0 | 1 | 0 | 1 | 0 | 0 | 0 | 1 | 1 | 1 | 0 | 0 | 0 | 1 |
| 13 | 0 | 0 | 0 | 1 | 0 | 0 | 1 | 1 | 0 | 1 | 0 | 0 | 1 | 0 | 1 | 1 |

CHART 4-continued

LOW "G" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 14 | 0 | 0 | 0 | 1 | 0 | 0 | 1 | 0 | 0 | 0 | 1 | 1 | 0 | 1 | 1 | 0 |
| 15 | 0 | 0 | 0 | 1 | 0 | 0 | 0 | 1 | 0 | 0 | 1 | 1 | 0 | 0 | 0 | 0 |
| 16 | 0 | 0 | 0 | 1 | 0 | 0 | 0 | 0 | 0 | 0 | 1 | 1 | 1 | 0 | 0 | 1 |
| 17 | 0 | 0 | 0 | 0 | 1 | 1 | 1 | 1 | 0 | 1 | 0 | 1 | 0 | 0 | 0 | 0 |
| BIT NUMBER | 16 | 15 | 14 | 13 | 12 | 11 | 10 | 9 | 8 | 7 | 6 | 5 | 4 | 3 | 2 | 1 |

CHART 5

"B" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 1 | 0 | 0 | 1 | 1 | 0 | 0 | 0 | 0 | 1 | 0 | 0 | 1 | 1 | 1 | 0 | 1 |
| 2 | 0 | 0 | 1 | 0 | 1 | 1 | 0 | 1 | 1 | 1 | 1 | 0 | 0 | 0 | 1 | 1 |
| 3 | 0 | 0 | 1 | 0 | 1 | 0 | 1 | 1 | 0 | 1 | 0 | 0 | 1 | 1 | 1 | 1 |
| 4 | 0 | 0 | 1 | 0 | 1 | 0 | 0 | 0 | 1 | 1 | 1 | 0 | 0 | 0 | 0 | 1 |
| 5 | 0 | 0 | 1 | 0 | 0 | 1 | 1 | 0 | 1 | 0 | 0 | 1 | 0 | 1 | 1 | 0 |
| 6 | 0 | 0 | 1 | 0 | 0 | 1 | 0 | 0 | 0 | 1 | 1 | 0 | 1 | 0 | 1 | 1 |
| 7 | 0 | 0 | 1 | 0 | 0 | 0 | 1 | 0 | 0 | 1 | 1 | 0 | 0 | 0 | 0 | 0 |
| 8 | 0 | 0 | 1 | 0 | 0 | 0 | 0 | 0 | 0 | 1 | 1 | 1 | 0 | 0 | 1 | 0 |
| 9 | 0 | 0 | 0 | 1 | 1 | 1 | 1 | 0 | 1 | 0 | 1 | 0 | 0 | 0 | 0 | 0 |
| 10 | 0 | 0 | 0 | 1 | 1 | 1 | 0 | 0 | 1 | 1 | 1 | 0 | 1 | 0 | 0 | 0 |
| 11 | 0 | 0 | 0 | 1 | 1 | 0 | 1 | 1 | 0 | 1 | 0 | 0 | 1 | 0 | 0 | 1 |
| 12 | 0 | 0 | 0 | 1 | 1 | 0 | 0 | 1 | 1 | 1 | 0 | 0 | 0 | 0 | 0 | 1 |
| 13 | 0 | 0 | 0 | 1 | 1 | 0 | 0 | 0 | 0 | 1 | 0 | 0 | 1 | 1 | 1 | 1 |
| 14 | 0 | 0 | 0 | 1 | 0 | 1 | 1 | 0 | 1 | 1 | 1 | 1 | 0 | 0 | 0 | 1 |
| 15 | 0 | 0 | 0 | 1 | 0 | 1 | 0 | 1 | 1 | 0 | 1 | 0 | 1 | 0 | 0 | 0 |
| 16 | 0 | 0 | 0 | 1 | 0 | 1 | 0 | 0 | 0 | 1 | 1 | 1 | 0 | 0 | 0 | 1 |
| 17 | 0 | 0 | 0 | 1 | 0 | 0 | 1 | 1 | 0 | 1 | 0 | 0 | 1 | 0 | 1 | 1 |
| BIT NUMBER | 16 | 15 | 14 | 13 | 12 | 11 | 10 | 9 | 8 | 7 | 6 | 5 | 4 | 3 | 2 | 1 |

CHART 6

LOW "E" STRING POSITION:

| FRET POSITION | OUTPUT OF GATE MATRIX 66 | | | | | | | | | | | | | | | |
|---|---|---|---|---|---|---|---|---|---|---|---|---|---|---|---|---|
| 1 | 0 | 1 | 0 | 0 | 0 | 0 | 0 | 0 | 1 | 1 | 1 | 0 | 0 | 1 | 0 | 0 |
| 2 | 0 | 0 | 1 | 1 | 1 | 1 | 0 | 1 | 0 | 1 | 0 | 0 | 0 | 0 | 0 | 0 |
| 3 | 0 | 0 | 1 | 1 | 1 | 0 | 0 | 1 | 1 | 1 | 0 | 1 | 0 | 0 | 0 | 0 |
| 4 | 0 | 0 | 1 | 1 | 0 | 1 | 1 | 0 | 1 | 0 | 0 | 1 | 0 | 0 | 0 | 1 |
| 5 | 0 | 0 | 1 | 1 | 0 | 0 | 1 | 1 | 1 | 0 | 0 | 0 | 0 | 0 | 0 | 1 |
| 6 | 0 | 0 | 1 | 1 | 0 | 0 | 0 | 0 | 1 | 0 | 0 | 1 | 1 | 1 | 0 | 1 |
| 7 | 0 | 0 | 1 | 0 | 1 | 1 | 0 | 1 | 1 | 1 | 1 | 0 | 0 | 0 | 1 | 1 |
| 8 | 0 | 0 | 1 | 0 | 1 | 0 | 1 | 1 | 0 | 1 | 0 | 0 | 1 | 1 | 1 | 1 |
| 9 | 0 | 0 | 1 | 0 | 1 | 0 | 0 | 0 | 1 | 1 | 1 | 0 | 0 | 0 | 0 | 1 |
| 10 | 0 | 0 | 1 | 0 | 0 | 1 | 1 | 0 | 1 | 0 | 0 | 1 | 0 | 1 | 1 | 0 |
| 11 | 0 | 0 | 1 | 0 | 0 | 1 | 0 | 0 | 0 | 1 | 1 | 0 | 1 | 0 | 1 | 1 |
| 12 | 0 | 0 | 1 | 0 | 0 | 0 | 1 | 0 | 0 | 1 | 1 | 0 | 0 | 0 | 0 | 0 |
| 13 | 0 | 0 | 1 | 0 | 0 | 0 | 0 | 0 | 0 | 1 | 1 | 1 | 0 | 0 | 1 | 0 |
| 14 | 0 | 0 | 0 | 1 | 1 | 1 | 1 | 0 | 1 | 0 | 1 | 0 | 0 | 0 | 0 | 0 |
| 15 | 0 | 0 | 0 | 1 | 1 | 1 | 0 | 0 | 1 | 1 | 1 | 0 | 1 | 0 | 0 | 0 |
| 16 | 0 | 0 | 0 | 1 | 1 | 0 | 1 | 1 | 0 | 1 | 0 | 0 | 1 | 0 | 0 | 1 |
| 17 | 0 | 0 | 0 | 1 | 1 | 0 | 0 | 1 | 1 | 1 | 0 | 0 | 0 | 0 | 0 | 1 |
| BIT NUMBER | 16 | 15 | 14 | 13 | 12 | 11 | 10 | 9 | 8 | 7 | 6 | 5 | 4 | 3 | 2 | 1 |

It is to be noted that Charts 4, 5, and 6 indicate that greater than the thirteen inputs (shown in FIG. 5) are needed as inputs for certain fret positions for the "G", "B" and "E" strings. In the gate matrices 66 for the instances additional bit number outputs would be provided to the shift register 68 over conductors 75 (FIG. 2) directly connected to the higher bit number outputs from decoder/demultiplexer 60.

The output frequency of the digital counter 38 is furnished to a frequency divider 76 and a frequency divider 78 so that an output signal at the designated frequency is provided as a first input to an integrator circuit representing the output frequency content of the output signal to be formed for the string touch pad S associated therewith. The frequency divider 76 further divides the input signal from the shift register 74 into other submultiples of the input frequency to thereby form harmonics which are selectively furnished, provided the switches 26 associated therewith are closed, through a variable resistor 82 to the integrator 80. The impedance value of the variable resistor 80 is controlled by the control knob 30 on the face portion 24 (FIG. 1) associated with the particular string touch pad S so that the amplitude of the selected harmonic contents, if any, of the output signal to be formed may be varied. The integrator 80 combines the selected harmonics and the output frequency signal from the frequency divider 78 to form the frequency content of the output signal which is provided to the voltage controlled amplifier 42.

Figure 7:
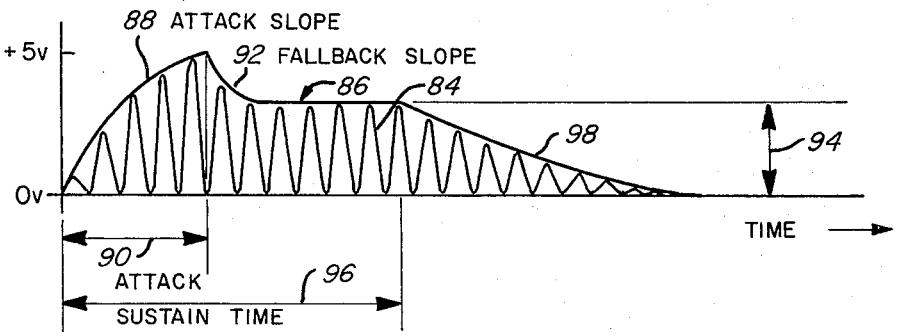
FIG. 7 is a waveform diagram of an example waveform produced in the electronic circuit of FIG. 2.

In FIG. 7, a sinusoidal waveform 84 illustrates in simplified format the frequency content of an example output signal formed in accordance with the present invention. The waveform 84 is contained within an envelope defining waveform 86. The envelope waveform 86 has an attack slope 88 during an attack time 90 defined by the pulse shaping network 40 and furnished through a buffer amplifier 92 to define initial portions of the output signal formed. The pulse shaping network 40 further defines the fallback slope 92 by which the initial attack amplitude decreases to a sustain amplitude 94 and is held for the duration of a sustain time 96 defined in the pulse shaping network 40. The pulse shaping network 40 further defines the decay slope 98 of the envelope of the output signal formed by the voltage controlled amplifier 42.

The pulse shaping network or envelope control circuit 40 (FIG. 6) is activated by a touch circuit 100 which is electrically connected to one of the string touch pads S on the face portion 24. Other than the electrical connection to the touch pad S rather than one of the fret touch pads F, the touch circuit 100 is of like structure and operation to the touch circuits 46 (FIG. 3). Accordingly, structural details of the touch circuit 100 are not shown in the drawings.

Figure 4:
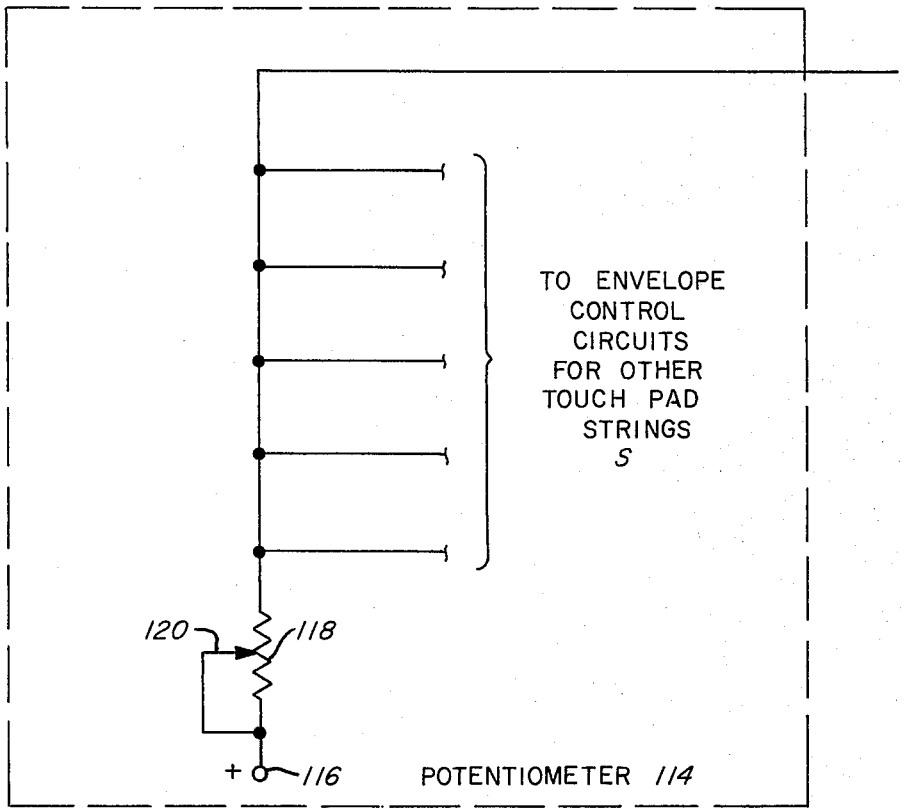

In the envelope control circuit 40 (FIG. 6), an attack time control circuit 102 and a sustain time control circuit 104 control the attack time 90 and sustain time 96 of the envelope 86 (FIG. 7), respectively. Further, an attack slope control circuit 106 and a fall back slope control circuit 108 (FIG. 6) control the attack slope 88 and fallback slope 92 of the envelope 86 (FIG. 7). A sustain amplitude control circuit 110 (FIG. 6) and a decay rate control circuit 112 define the sustain amplitude 94 and the decay rate 98 of the envelope 86 (FIG. 7). Each of the foregoing control circuits in the envelope control circuit 40 has a potentiometer 114 associated therewith and controlled by one of the control knobs 28 (FIG. 1) to permit a user of the instrument I to define the various parameters of the envelope 86 to be formed for each of the strings in the instrument I. Each of the potentiometers 114 is of like structure, but of course may be individually set by the knob 28 connected therewith so that the six various parameters of the envelope 86 may be individually adjusted according to the user's desired output musical note or chord. Accordingly, only one of the potentiometers 114 is shown in the drawings (FIG. 4). Each of the potentiometers 114 (FIG. 4) receives operating electrical power at an input terminal 116 so that electric current flows through a variable resistor 118 whose resistance value is controlled by a movable wiper arm 120 moving in response to adjustment of the knob 28 (FIG. 1) associated therewith. Each of the potentiometers 114 has a light emitting diode 122 or other suitable light emitting semiconductor electrically connected thereto so that variations in the resistance value of the variable resistor 118 by adjustment of the control knob 28 varies the current flowing through the light emitting diode 122, and accordingly the output light intensity thereof.

In the attack time control circuit 102, the light output intensity from light emitter 122 connected to the potentiometer 114, which is set by one of the knobs 28, controls the amount of current which flows through a photoresistor 124, and accordingly controls the duration of time that a timer semiconductor 126 provides an output signal at an output terminal **126*a* in response to activation by the touch circuit 100. Similarly, a phototransistor 128 of the sustain time control circuit 104 conducts at a current intensity controlled by a light emitter 122 associated therewith and controls the time duration that a timer semiconductor 128 provides an output signal at an output terminal 128*a*. Again, the light intensity reaching the photoresistor 128 is controlled by one of the knobs 28 which sets the potentiometer 114 associated with sustain time control circuit 104**.

The time duration that the timer semiconductor 126 forms an output signal specifies the attack time 90 (FIG. 7) for the envelope 86. The time duration that the timer semiconductor 128 forms an output signal specifies the sustain time 96 for the envelope 86.

Figure 6:
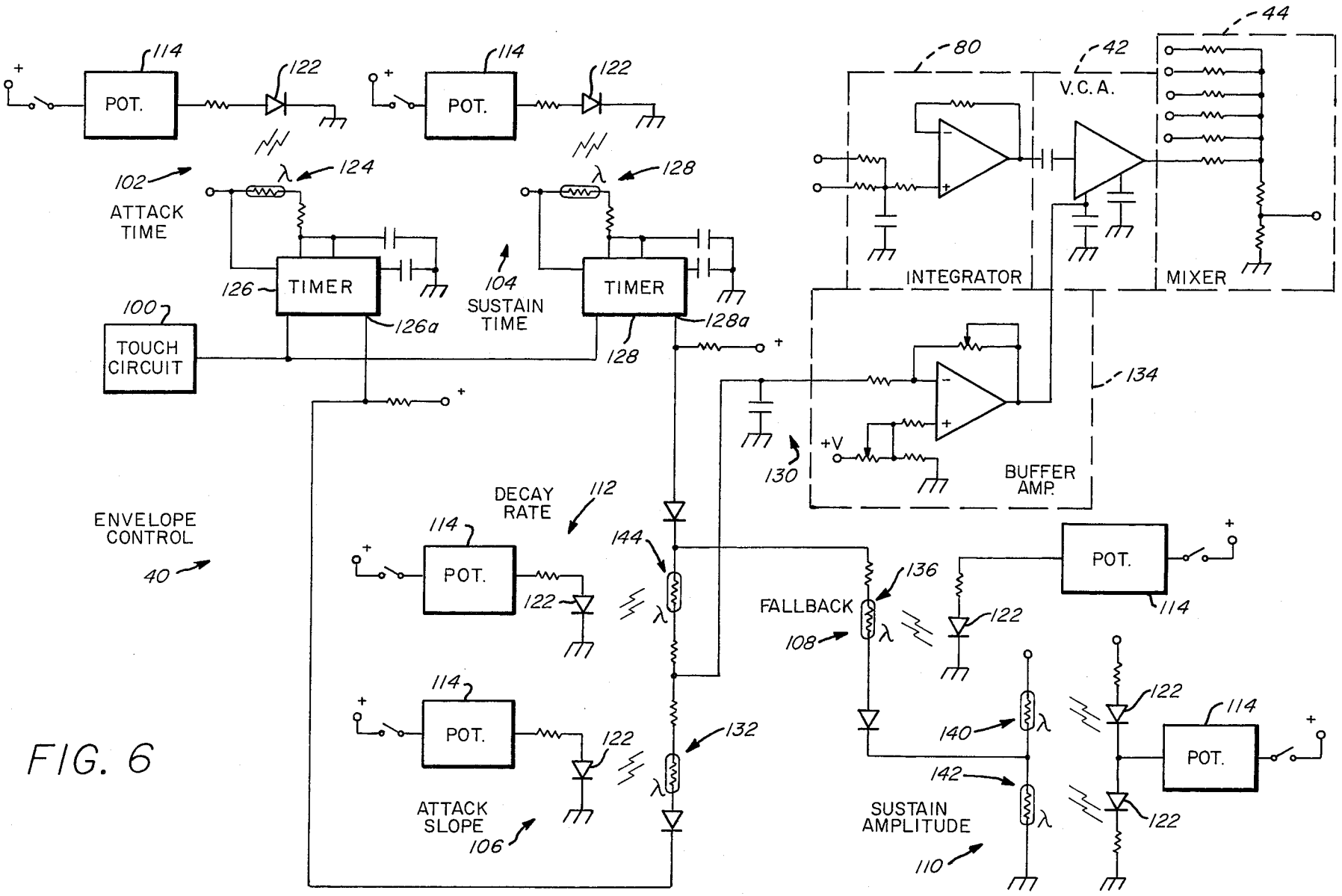

During the attack time 90, a capacitor 130 (FIG. 6) in the envelope control circuit 40 is charged by electrical current flowing through a photoresistor 132 of the attack slope control circuit 106. The intensity of current flowing through the photoresistor 132 is controlled by the light output of the light emitter 122 connected to potentiometer 104 of attack slope control circuit 106. Consequently, the amount of current flowing into the capacitor 130 to charge the capacitor is controlled by the setting of the knob 28 associated with attack slope control circuit 106. The charge accumulating in the capacitor 130 during the attack time 90 represents a voltage which is provided as a input signal to a buffer amplifier 134 to define the attack slope 88 (FIG. 7) formed by the voltage controlled amplifier 42 (FIG. 6).

After the attack time 90 has elapsed, the charge accumulated in the capacitor 130 is partially drained through a photoresistor 136 of the fallback control circuit 108. The amount of current permitted to flow through the photoresistor 136 is controlled by the light emitter 122 and potentiometer 114 in response to the setting of the control knob 28 associated therewith and thus the declining output of buffer amplifier 134 is response to current drain from capacitor 130 through transistor 144 defines the fallback slope 92 (FIG. 6).

The draining of current from the capacitor 130 (FIG. 6) through the photoresistor 136 continues until a voltage level specified by photoresistors 140 and 142 of the sustain amplitude control circuit 110 is reached. Again, the amount of electrical current flowing through the photoresistors 140 and 142 is set by the control knob 28 associated with the sustain amplitude control circuit 110 so that the voltage level represented by the stored charge on the capacitor 130 at the time at the photoresistor 136 ceases conducting represents, after amplification in the buffer amplifier 134, the control signal provided to the voltage controlled amplifier 42 to form the sustain amplitude 94 (FIG. 7) of the envelope 86.

The sustain amplitude 94 of the envelope 86 is maintained by the voltage control amplifier due to the charge on the capacitor 130 (FIG. 6) until timer 128 ceases forming an output signal, indicating that the sustain time 96 has elapsed. At this time, the charge remaining stored in the capacitor 130 is drained by means of a photoresistor 144 of the decay rate control circuit 112. Again, the rate of flow of current through the photoresistor 144 is controlled by a light emitter 122 in response to the setting of a potentiometer 114 by the control knob 28 on the face portion of the instrument I to define the decay slope 98 (FIG. 7) of the envelope 86.

In the operation of the present invention, the user of the instrument I sets the input knobs 28 on the face portion 24 in accordance with the desired configuration of the envelope 86 to be formed in envelope control circuit 40 for the notes and chords. If harmonic signals are desired, the user sets the particular ones of the switches 26 of the input means M according to the particular harmonics desired, and sets the knobs 30 to control the potentiometers 82 for each of the string pads S for which harmonics are desired. During the course of play of the instrument I, the various settings of the input means M are, of course, adjusted by the user in accordance with the output music desired to be played in the instrument I.

As the user's fingers are moved to various groupings of the fret touch pads F in accordance with the notes and chords to be formed and as the user's fingers strum the string touch pads S in the normal manner of play, various notes and chords are specified, with the location of the use's fingers on the fret touch pads F defining the frequencies of the notes and chords to be formed in the output signals from the instrument I. Contact of the user's fingers with particular ones of the string touch pads S specifies which strings are activated in forming the chords.

The touch control circuits 46 of the input means M define the frequency content of the output signals to be formed for the particular strings, and the digital circuit 36 responds thereto to provide a digital count signal to the digital counter 38. The output frequency from the clock 34 is divided in the digital counter 38 in response to the digital count from the digital circuit 36 to form the output signal frequency. If desired, as specified by the switches 26 of the input means M, harmonics are furnished to the integrator 80 in addition to the output signal frequency, where the harmonic signals are combined with the output signal frequency. The output of integrator 80 is provided to the voltage-controlled amplifier 42 to specify the frequency content of the output signal for the string touch pad S associated therewith. The settings of the control knobs 28 specify the envelope of the signal formed in the pulse shaping network 40 for the string touch pads S contacted by the user's fingers so that the buffer amplifier 134 drives the voltage controlled amplifier 42 causing the envelope 86 to be formed for the output signal for the particular string touch pad S associated therewith. The outputs from the various voltage control amplifiers 42 for each of the string touch pads S are summed in the mixer 44 and provided as the output signal to a load speaker, recording device or other suitable output means for listening, recording or other use.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

I claim:

1. An electronic musical instrument for electrically forming output signals having at least one frequency component and an amplitude defining envelope to simulate musical notes and chords from a stringed musical instrument, comprising:

(a) input means for receiving an indication from a user of the output signal to be formed, said input means comprising:

(1) a plurality of string touch pad means corresponding in number of the number of strings on the musical instrument being simulated, each of said string touch pad means representing one of the strings being simulated;

(2) touch circuit means individually associated with each of said string touch pad means for forming an electrical signal when the string touch pad means associated therewith is contacted;

(3) control input means for permitting the user to specify the envelope of the output signal being formed;

(4) input switch means for permitting the user to selectively form harmonic frequencies of notes being formed in the instrument;

(5) control knob means, equal in number to said string touch pad means, for permitting a user to indicate the level of the harmonic frequencies being formed;

(b) oscillator means for forming a reference clock frequency pulse signal;

(c) digital circuit means for forming digital count signals defining the frequency component of the output signal to be formed in response to receipt of electrical signals from said touch circuit means;

(d) digital counter means responsive to the digital count signal from said digital circuit means for dividing the frequency of the reference clock frequency pulse signal to form the output signal frequency; and (e) envelope control circuit means for forming the envelope of the output signal in response to that specified by said control input means.

2. The apparatus of claim 1, wherein said envelope control circuit comprises:

means for controlling the attack time of the envelope of the output signal.

3. The apparatus of claim 1, wherein said envelope control circuit comprises:

means for controlling the attack slope of the envelope of the output signal.

4. The apparatus of claim 1, wherein said envelope control circuit comprises:

means for controlling the sustain time of the envelope of the output signal.

5. The apparatus of claim 1, wherein said envelope control circuit comprises:

means for controlling the fallback slope of the envelope of the output signal.

6. The apparatus of claim 1, wherein said envelope control circuit comprises:

means for controlling the sustain amplitude of the envelope of the output signal.

7. The apparatus of claim 1, wherein said envelope control circuit comprises:

means for controlling the decay slope of the envelope of the output signal.

8. The apparatus of claim 1, wherein said digital circuit means comprises:

(a) selector means responsive to said input means for selecting the highest frequency component defined for the strings; and (b) gating circuit means for forming a digital code representing the digital signal and furnishing the digital code to said digital counter means.

9. The apparatus of claim 1, wherein said digital counter means includes:

means for selectively forming harmonic frequencies of the output signal frequency.

10. The apparatus of claim 9, further including:

means for combining the harmonic frequencies with the output signal frequency.

11. The apparatus of claim 1, wherein said input means further includes:

(a) a plurality of fret touch pad means corresponding in number to the number of frets on the musical instrument being simulated, each of said fret touch pad means representing one of the frets being simulated;

(b) touch circuit means individually associated with each of said fret touch pad means for forming an electrical signal when the fret pad means associated therewith is contacted.

* * * * *